US005429108A

United States Patent [19]

Hsieh

[11] Patent Number: 5,429,108

[45] Date of Patent: Jul. 4, 1995

[54] AIR-OPERATED TOY GUN

[76] Inventor: Yin-Wang Hsieh, No. 91, Yu Ming Street, Pan Chiao City, Taipei Hsien, Taiwan

[21] Appl. No.: 138,001

[22] Filed: Oct. 19, 1993

[51] Int. Cl.[6] ..... F41B 11/12; F41J 3/02

[52] U.S. Cl. ..... 124/65; 124/60; 124/63; 124/56; 273/381

[58] Field of Search ..... 124/69, 65, 64, 63, 124/60, 58, 56, 67, 66, 61, 70, 73; 273/381, 379; 446/487

[56] References Cited

U.S. PATENT DOCUMENTS

| | | | |
|---|---|---|---|
| 1,818,810 | 8/1931 | Miller | 124/69 |
| 2,899,204 | 8/1959 | Ratay | 273/381 |
| 3,782,727 | 1/1974 | Chirnomas | 273/381 |
| 4,732,136 | 3/1988 | Ferri . | |
| 5,224,464 | 7/1993 | Burnham et al. . | |
| 5,242,323 | 9/1993 | Rappaport | 124/63 |

FOREIGN PATENT DOCUMENTS

| | | | |
|---|---|---|---|
| 462616 | 3/1951 | Italy | 124/63 |

*Primary Examiner*—Randolph A. Reese
*Assistant Examiner*—Anthony Knight
*Attorney, Agent, or Firm*—Varndell Legal Group

[57] ABSTRACT

An air-operated toy gun including a gun body, a triggering device, an air pump device, and a projectile. The air pump device is arranged inside the gun body and has an air cylinder. A blow tube that is connected to the air cylinder has an end extending out of the gun body. A piston is driven by the triggering device within the air cylinder to produce compressed air. The tubular projectile, made of a medium hard foam material and closed at one end, is mounted on the front end of the blow tube. When compressed air, produced by the movement of the piston in the air cylinder by movement of the triggering device, exhausts from the blow tube; the projectile is ejected forward, resulting in an amusement effect.

2 Claims, 5 Drawing Sheets

AIR-OPERATED TOY GUN

BACKGROUND OF THE INVENTION

The invention relates to air-operated toy guns and, more particularly, to a toy gun that makes use of compressed air generated by an air pump to launch a soft projectile mounted on a blow tube of the air pump.

A conventional toy gun makes use of a hammering mechanism situated on the rear portion thereof to hit firing powder to produce a loud sound. Recently, the designs of toy guns tend to imitate real shooting. An example is a BB shot gun, which fires BB bullets. However, the former conventional toy gun does not provide a realistic feeling of shooting. The latter conventional toy gun uses compressed air to propel BB bullets that are made of a plastic material with a considerable hardness and, accordingly, it may cause an injury to the users thereof and thus is not safe.

SUMMARY OF THE INVENTION

In view of the deficiencies described above, the invention is directed to providing a structure of an air-operated toy gun that makes use of an air pump device to produce compressed air and propel a projectile mounted on the blow tube of the air pump device, which permits the user to experience the fun of real shooting. In addition, the projectile is made of a light weight material with a low hardness such as polyfoam or silicon adhesives and, therefore, it is not only easy for air to propel but also safe for playing.

An embodiment of the invention is described below in conjunction with the accompanying drawings, from which the construction and features of the invention will be readily appreciated.

DETAILED DESCRIPTION OF THE PREFERRED EMBODIMENTS

Figure 1:
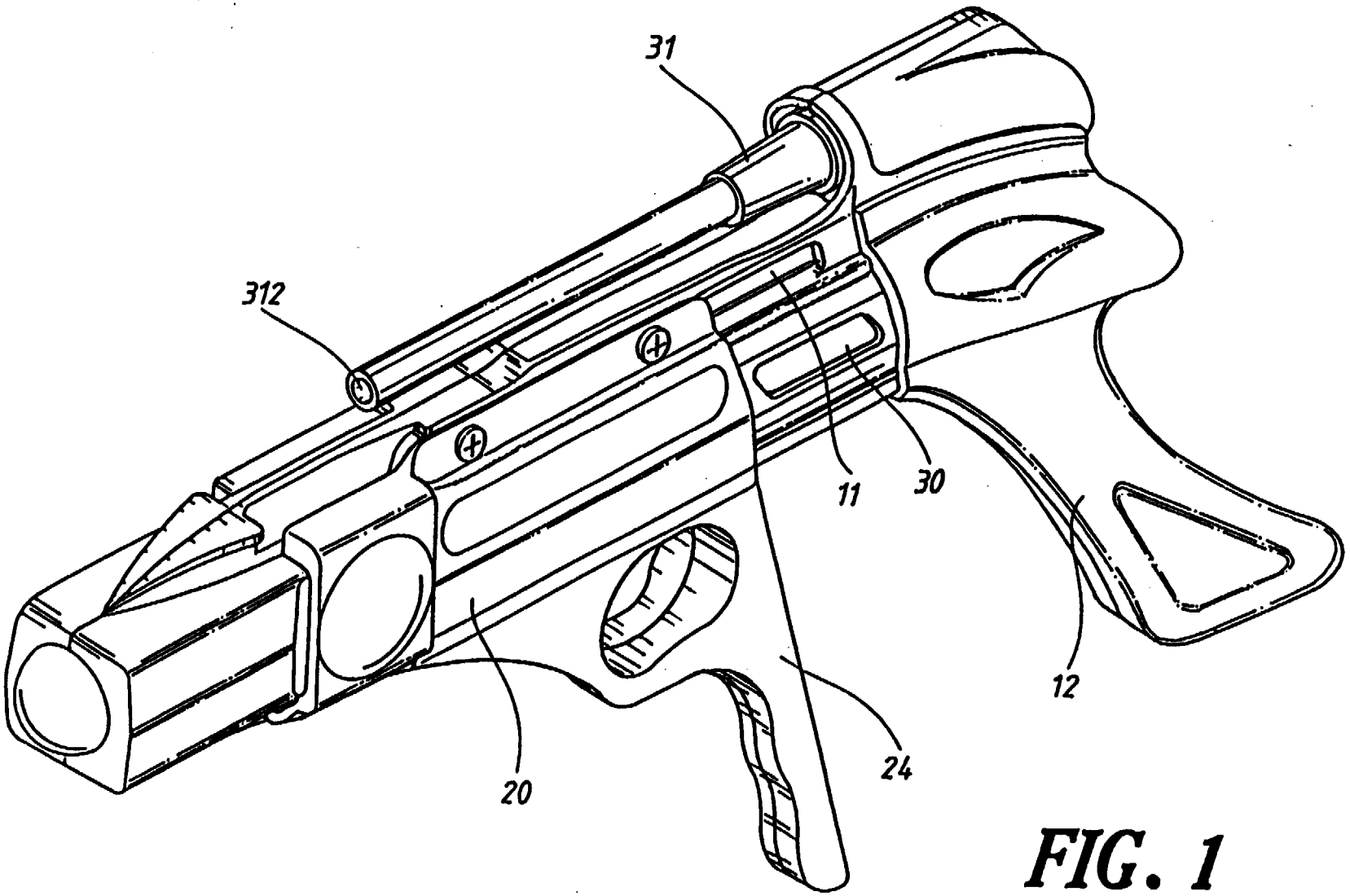
FIG. 1 is a perspective view showing the outer appearance of an air-operated toy gun according to the invention.
Figure 2:
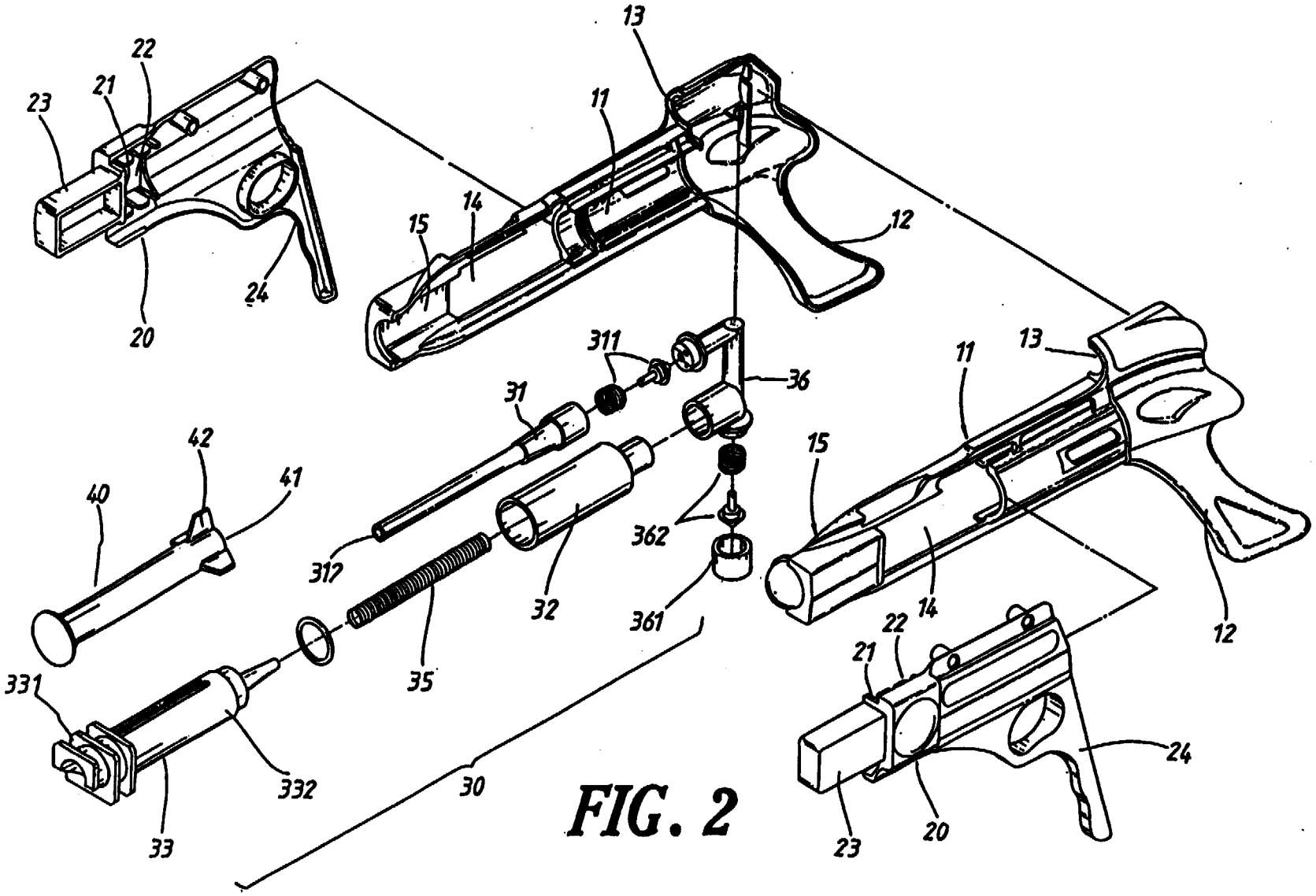
FIG. 2 is an exploded view of the toy gun of FIG. 1.

Referring to FIGS. 1 and 2, the gun structure of the invention mainly comprises a gun body, a triggering device 20, a pump device 30, and a projectile 40. The gun body is provided with a chamber 11 in which the pump device 30 is mounted, and a hand grip 12 that makes it easy for the user hold. At an appropriate location in the chamber 11 an opening 13 is provided that communicates with a blow tube 31 of the pump device 30. On one end of the chamber 11 an insertion hole 14 is arranged. A pull portion 21 of the triggering device 20 is received in the insertion hole 14. The pull portion 21 is arranged in front of the pump device 30 and drives the air cylinder 32 of the pump device 30.

The triggering device 20 is slidably supported in front of the hand grip 12 of the gun body. The pull portion 21 of the triggering device 20 extends into the chamber 11 through the insertion hole 14 of the gun body and is arranged to move the front end portion 331 of the piston

33 toward the air cylinder 32 with the aid of an engagement portion 22. In front of the pull portion 21 is a guiding portion 23 that movably slides in a guide slot 15 situated on the front end of the chamber 11. The guide slot 15 confines the movement of the triggering device 20 to a predetermined path and range. The triggering device 20 is provided with a lever 24, having a shape that makes it easy for user to operate the air-operated toy gun by his or her fingers.

The pump device 30 includes an air cylinder 32 and a blow tube 31. The air cylinder 32 has a piston 33 with the rear end 332 thereof extending into the interior of the air cylinder 32 that is biased forward by a resilient element 35. The front end 331 of the piston 33 extends out of the air cylinder 32 and engages the engagement portion 22 of the triggering device 20. When the lever 24 of triggering device 20 moves towards the hand grip 12 of the gun body, the rear end 332 of the piston 33 squeezes air within the air cylinder 32 forming compressed air inside the air cylinder 32. The end of the air cylinder 32 is connected to an air flow guide device 36 that includes an air inlet 36 1 and a blow tube 31 extending to the outside. A check valve 362 permitting only inward air flow is mounted inside the air inlet 361 while another check valve 311 permitting only outward air flow is installed inside the blow tube 31. An air outlet 317 is provided on the end of the blow tube 31.

The projectile 40, a long tubular body made of a soft material, is provided with an opening 41 at the tail end thereof for mounting the projectile on the blow tube 31, an opposing closed end, and a plurality of tail fins 42 to stablize the flight of the projectile 40.

Figure 3:
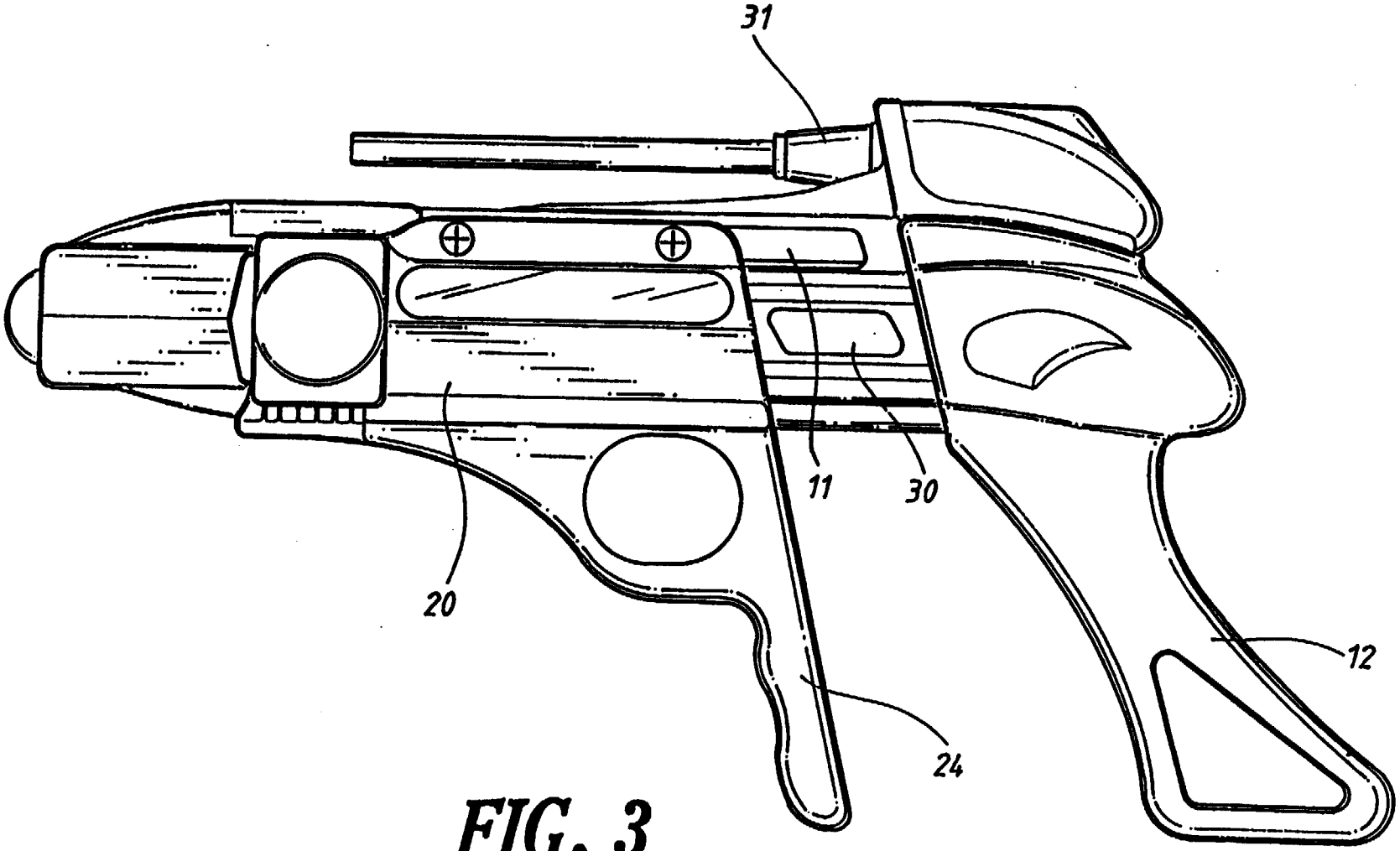
FIG. 3 is a schematic view illustrating the action of the toy gun shown in FIG. 1 before shooting.
Figure 4:
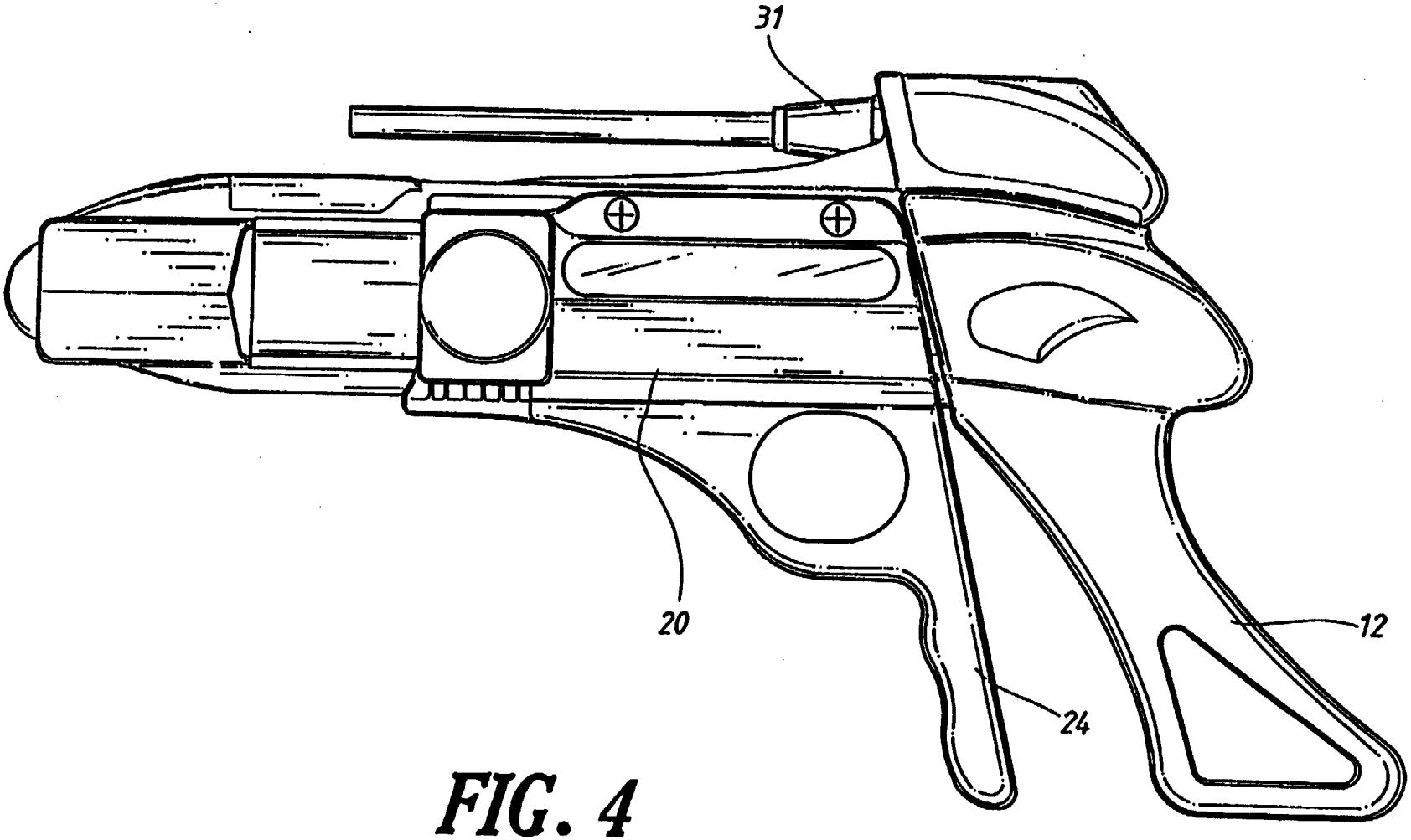
FIG. 4 is another schematic view indicating the action of the toy gun during shooting.

Referring to FIGS. 3 and 4, with this arrangement, the toy gun is operated as follows. An operator quickly pulls the triggering device 20 backwards, which simultaneously drives the piston 33 rearwards to produce compressed air. The compressed air is guided into the blow tube 31 and then exhausts from the outlet 317, resulting in a propellant force for ejecting the projectile 40 and attaining an amusement effect.

Figure 5:
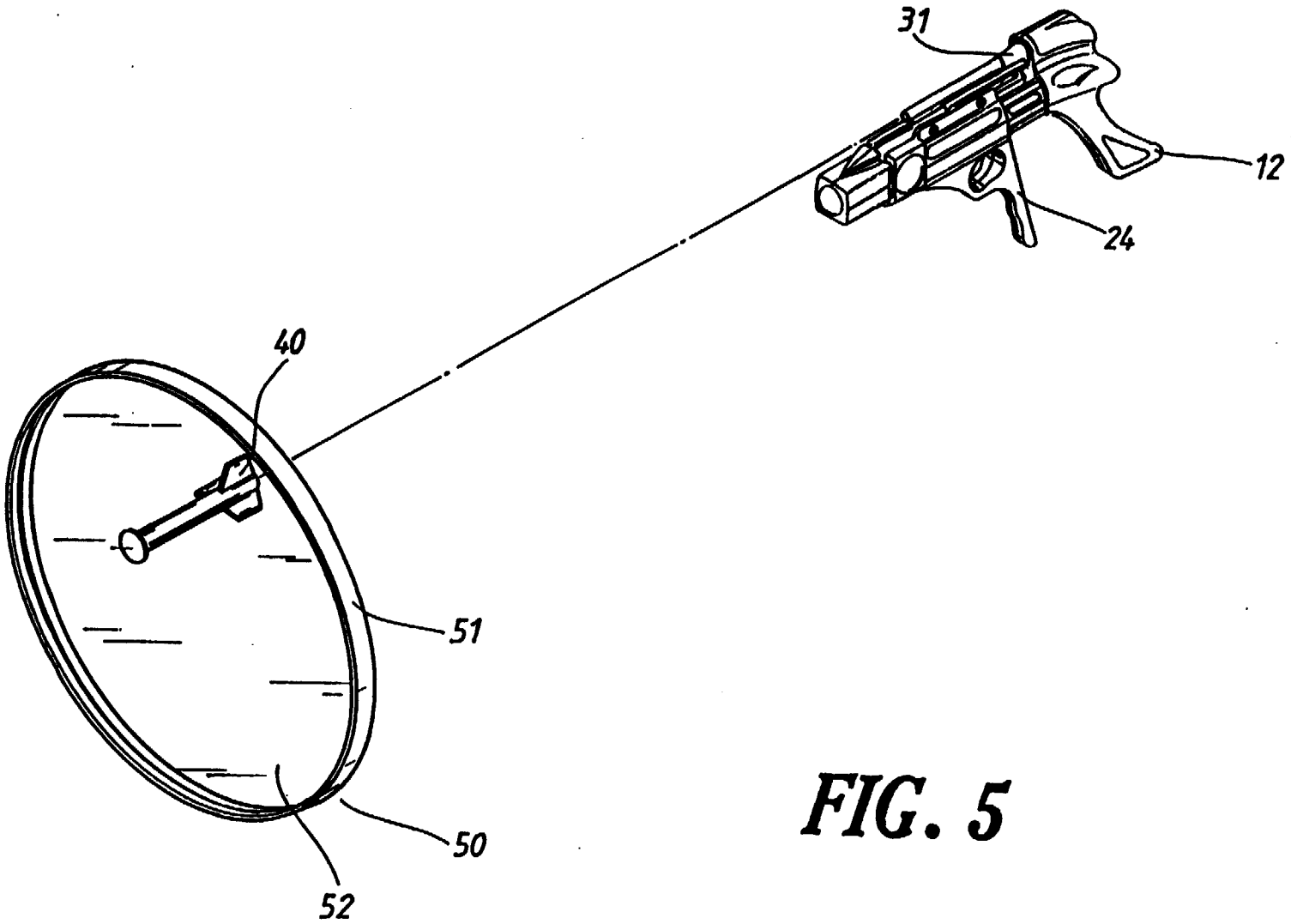
FIG. 5 is a schematic view showing an embodiment of toy target according to the invention.

Referring to FIG. 5, a target 50 can be used together with the toy gun of the invention. The target 50 is constructed in a manner that a thin sheet 52 made of a high resilient material such as an acrylic film is tightly stretched and supported on a ringlike frame, forming a target surface functioning like a drum head. When the projectile 40 is ejected from the gun and hits the target surface with its soft front end, the target will produce a loud sound, resulting in another interesting effect.

As described above, the toy gun of the invention is not only a toy having a feature of launching objects and promoting an amusement effect of air-operated toy guns, but also provides a safe plaything due to its soft projectiles, eliminating the defects of a conventional toy gun. The associated target can also provide excitement with its sound effect. Therefore, it indeed is a new, complete, safe structure for a toy gun.

What is claimed is:

1. An air-operated toy gun comprising a pump means for producing compressed air, a triggering means for activating said pump means, a gun body means for holding said pump means and said triggering means, and a projectile;

said pump means including an air cylinder, a piston with a rear end received in said air cylinder and a front end extending out of said air cylinder, a resilient element biasing said piston forward, an air guide device connected to said air cylinder having an air inlet and a blow tube with an opened end, said air inlet equipped with an intake check valve and said blow tube equipped with an outlet check valve, said projectile mounted on said opened end of said blow tube;

said gun body means including a hand grip, a chamber receiving said air cylinder of said pump means, an insertion hole arranged in front of said chamber slidably receiving said front end of said piston, a guiding slot, and an upper opening through which said opened end of said blow tube extends;

said triggering means including an integrally formed pull portion, engagement portion and lever; said pull portion slidably received in said guiding slot of said gun body means, said guiding slot confining movement of said pull portion to a predetermined path and range, said engagement portion engaging said front end of said piston, and said lever and said hand grip each having downward extending portions of approximately equal lengths, said downward extending portions arranged in a common plane with said lever in front of said hand grip; and said projectile including a long hollow tubular body having a rear end mounted on said blow tube and a closed front end;

wherein said lever of said triggering means is biased away from said hand grip of said gun body means by action of said resilient means; and pulling said lever towards said hand grip causes said piston to compress air in said air cylinder, the compressed air exiting from said opened end of blow tube and launching said projectile.

2. An air-operated toy gun as claimed in claim 1, wherein a target is used in conjunction with said toy gun, said target having a highly resilient thin sheet tightly stretched and supported by a side frame in the shape of a drum; and when said projectile hits said target, a loud sound is produced.

* * * * *